United States Patent [19]

Navi

[11] 4,048,913

[45] Sept. 20, 1977

[54] APPARATUS FOR REPETITIVE IMPRINTING AT UNIFORM INCREMENTS ON A CONTINUOUSLY MOVING WEB

[75] Inventor: Menashe Navi, Elizabeth, N.J.

[73] Assignee: Adolph Gottscho, Inc., Union, N.J.

[21] Appl. No.: 503,882

[22] Filed: Sept. 6, 1974

[51] Int. Cl.[2] ..... B41F 1/04

[52] U.S. Cl. ..... 101/27; 101/288; 101/297; 101/298

[58] Field of Search ..... 101/27, 35, 44, 291, 101/126, 316, 212, 250, 251, 252, 253, 260, 272, 273, 282, 283, 287, 288, 292, 297, 298, 299, 301, 332

[56] References Cited

U.S. PATENT DOCUMENTS

| | | | |
|---|---|---|---|
| 1,189,747 | 7/1916 | Smith | 101/44 |
| 2,819,671 | 1/1958 | Porter, Jr. et al | 101/44 |
| 3,078,792 | 2/1963 | Kerstan | 101/126 |
| 3,244,092 | 4/1966 | Gottscho et al. | 101/27 X |
| 3,331,320 | 7/1967 | Young et al. | 101/27 X |
| 3,552,308 | 1/1971 | Minehart | 101/37 |
| 3,641,930 | 2/1972 | Riddington | 101/35 |
| 3,765,326 | 10/1973 | Hawkins | 101/44 |
| 3,815,494 | 6/1974 | Bahnmuller | 101/27 X |

*Primary Examiner*—Edward M. Coven
*Attorney, Agent, or Firm*—Blum, Moscovitz, Friedman & Kaplan

[57] ABSTRACT

A printing apparatus for webs continuously moving along a path wherein a printing head is cyclically displaced along a further path which includes a portion extending substantially along the web path, the printing head engaging the web against a displaceable back-up member while traversing said portion of its path, the print head being spaced from the web path during the remaining portion of each cycle. Apparatus is provided for selectively adjusting the velocity of the print head while in engagement with the web and back-up member so that the print head and web are moving at substantially the same velocity. The print head may be a heated die, in which case a heat-released pigment bearing strip is incrementally advanced to the region intermediate the print head and web when the print head is spaced from the web and is engaged against the web by the heated die when the print head engages the web.

39 Claims, 15 Drawing Figures

8-8
4-4
5-5

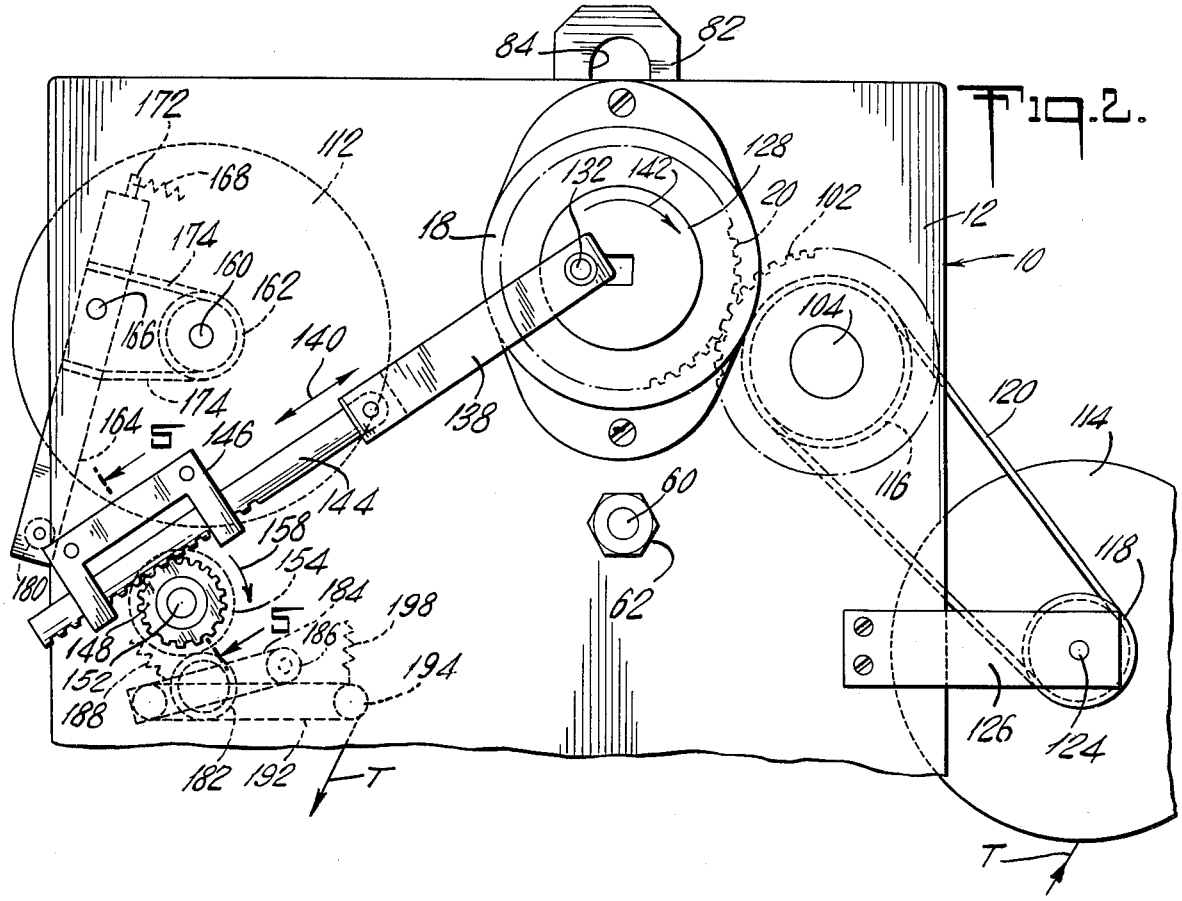
Fig. 2.
Fig. 3.
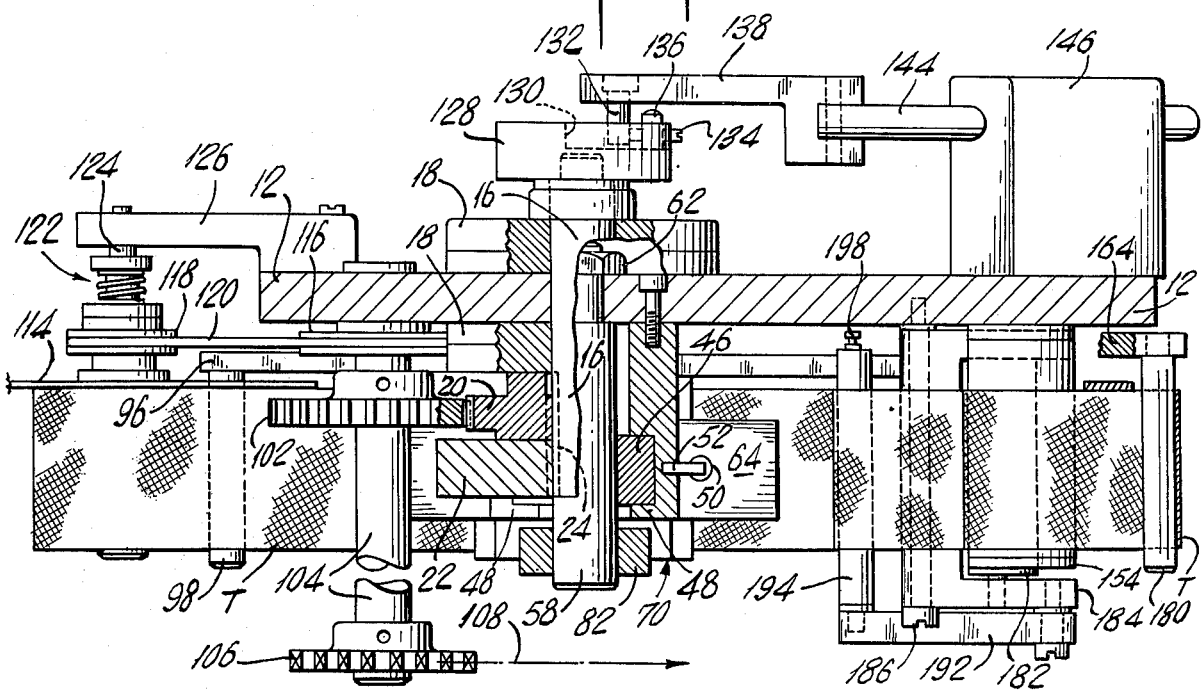

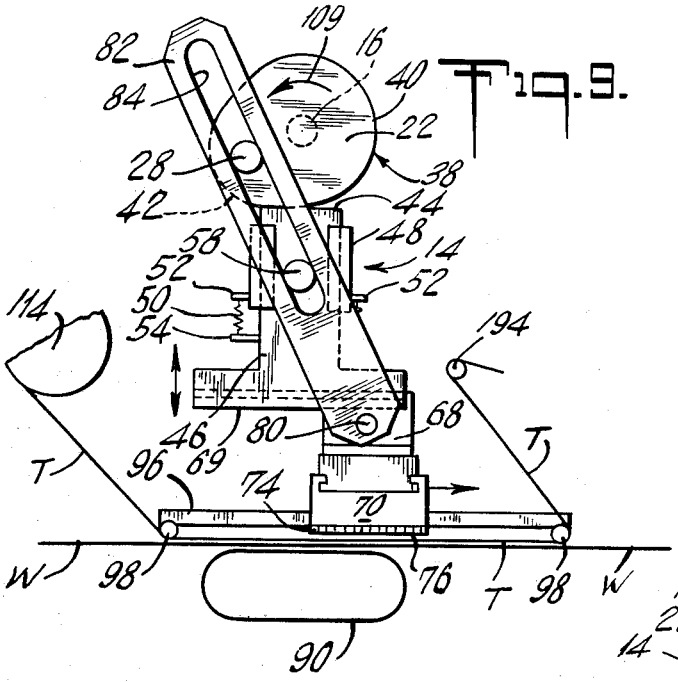
Fig. 9.
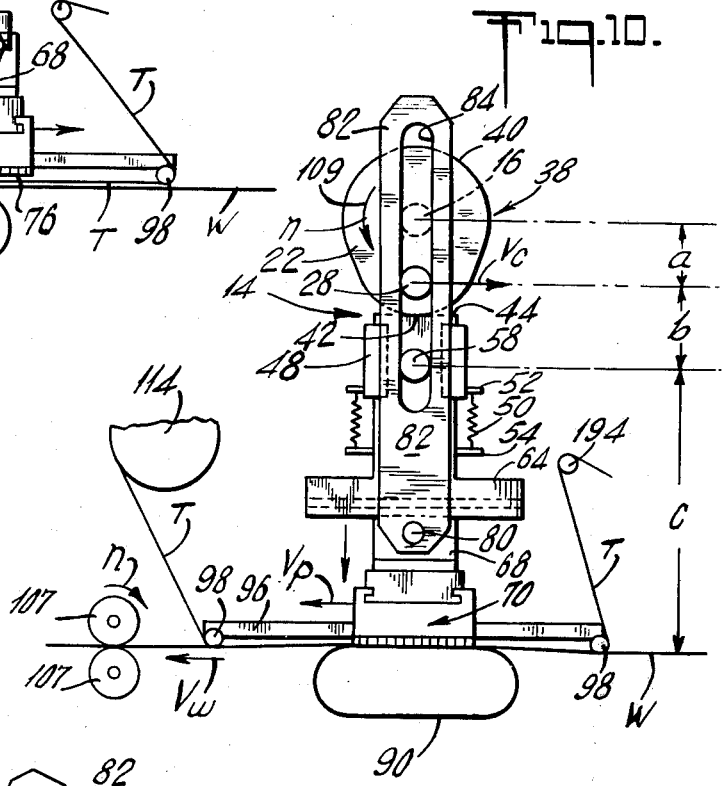
Fig. 10.
Fig. 11.
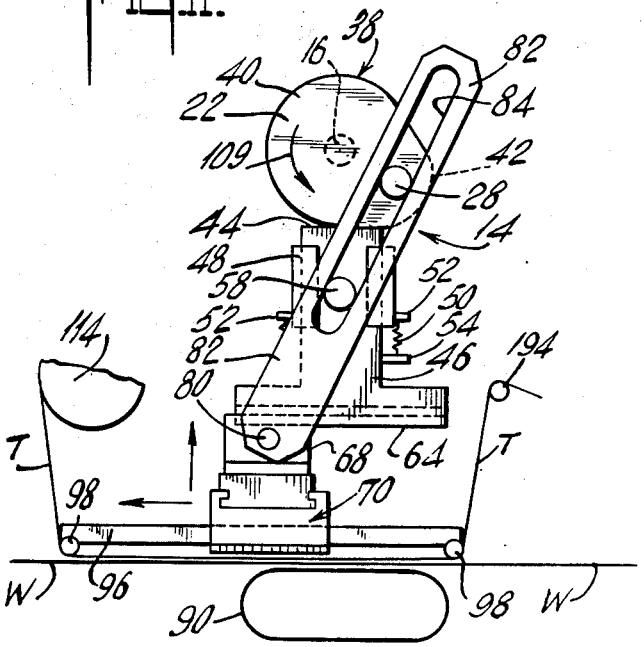
Fig. 12.
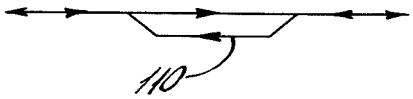

APPARATUS FOR REPETITIVE IMPRINTING AT UNIFORM INCREMENTS ON A CONTINUOUSLY MOVING WEB

BACKGROUND OF THE INVENTION

This invention relates to improvements in printing or marking apparatus for continuously moving webs. For example, webs of sheet material are frequentlly continuously advanced to a wrapping or other packaging machine which utilizes predetermined lengths, hereinafter referred to as the cut-off length, of the web. For many packaging applications, it is desirable to imprint each incremental length of material with a desired imprint, such as an identification or dating cade, product identification, trademark or the like. Many such packaging machines are adapted to adjust the cut-off length of web material upon which the packaging machine operates independent of the cycle time thereof. In order to insure proper imprinting, the printing or marking apparatus must be similarly adjustable.

Further, the webs of sheet material are frequently formed from plastics or metallic foils, in which case the preferred printing or marking techniques requires the use of a heat-released pigment bearing tape pressed against the sheet material by a heated die or printing so as to transfer pigment from the tape to the sheet material, thereby forming the desired marking or imprint on the latter. Such printing or marking apparatus is generally referred to as a hot printer. In order for proper printing to be effected on a continuously moving web by means of a hot leaf printing or marking apparatus without tearing the web, the heated die must engage the web while traveling therewith at the same velocity as the web for a sufficient period of time to release the pigment from the hot leaf tape.

It is also desirable to provide a heated die of sufficient cross-sectional area so as to permit the imprinting of a substantial block of information during each imprinting. This requires the use of a substantially flat back-up member against which the heated die presses the hot leaf tape and web to insure even imprinting over a relatively large area, all of which must be accomplished while the web, heated die and back-up member are moving at substantially the same velocity.

By using the apparatus in accordance with the invention, the foregoing goals can be achieved.

SUMMARY OF THE INVENTION

Generally seaking, in accordance with the invention, a printing apparatus for webs continuously moving along a first path is provided including printing means positioned on one side of said first path and back-up means on the other side of said web facing said printing means and mounted for displacement in the direction of web movement. Means is provided for cyclically displacing said printing means along a second path having a first portion extending substantially along said first path and a second portion spaced from said first path. The printing means engages the web against the back-up means while in said first portion of said second path to effect printing. The means for displacing said printing means includes means for selectively adjusting the velocity of said printing means during the traverse by said printing means of the first portion of said second path to maintain the respective velocities of the engaged printing head and web substantially equal. Means is provided for displacing the back-up means with the web and printing means when the printing means engages the web thereagainst.

The printing means may include a heated die and means for incrementally advancing a heat-released pigment bearing tape in the region intermediate the heated die and web during the period that the printing head is traversing the second portion of said second path, the heated die engaging the pigment bearing tape against the web during the period that the heated die is traversing the first portion of said second path.

The means for displacing the printing means includes a first displacing means for displacing the printing means toward and away from the web and a second displacing means for displacing the printing means substantially parallel to said first path. Said first and second displacement means operates in coordination, said first displacement means being operative only during the second portion of said second path. Said second displacement means may include a cam, continuously rotating about an axis and having a camming surface variously spaced from said axis, coupled to said printing means to effect the displacement thereof toward and away from the web.

The second displacement means may include a lever arm having a centrally slotted portion for engagement against a fixed pivot, a slotted first end portion for engagement with a pivot member continuously rotating about a fixed axis and a second end pivotably engaging said printing head, said velocity adjusting means including means for selectively radially positioning said continuously rotating pivot member relative to fixed axis thereof. Said continuously rotating pivot member may be mounted on said cam for rotation therewith.

The pigmented tape advancing means is actuated in coordination with the continuous rotation of the cam and includes means for translating such continuous rotation to reciprocal displacement of a rack, said rack being coupled to a pigmented tape advance roller through a pinion and one-way clutch means. Tape support means is mounted on the printing means for the displacement of the pigmented tape means with the printing means, web and back-up means during printing. Means is provided for adjusting the length of tape advanced during each cycle.

Accordingly, it is an object of this invention to provide an improved printing apparatus permitting imprinting at incremental locations along a continuously moving web.

Another object of the invention is to provide a hot leaf printing apparatus for imprinting on a continuously moving web.

A further object of the invention is to provide a hot leaf printing apparatus for imprinting blocks of information on continuously moving webs.

Still another object of the invention is to provide a hot leaf printing apparatus for use in conjunction with a packaging machine including means for selectively adjusting the spacing between imprints to correspond to the cut-off length of the packaging machine while maintaining a fixed relation between the respective cycle times of the printing apparatus and packaging machine.

Still other objects and advantages of the invention will in part be obvious and will in part be apparent from the specification and drawings.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a front elevational view of the printing apparatus in accordance with the invention with portions broken away;

FIG. 2 is a fragmentary rear elevational view of the printing apparatus of FIG. 1;

FIGS. 3, 4 and 8 are sectional views respectively taken along lines 3—3, 4—4 and 8—8 of FIG. 1;

FIGS. 9, 10 and 11 are simplified front perspective views of the printing apparatus of FIG. 1 illustrating the relative orientation of the components at three positions thereof;

FIG. 12 is a line diagram illustrating the path followed by the print head of the printing apparatus of FIG. 1 during each cycle thereof;

DESCRIPTION OF THE PREFERRED EMBODIMENTS

Figures 1, 8:
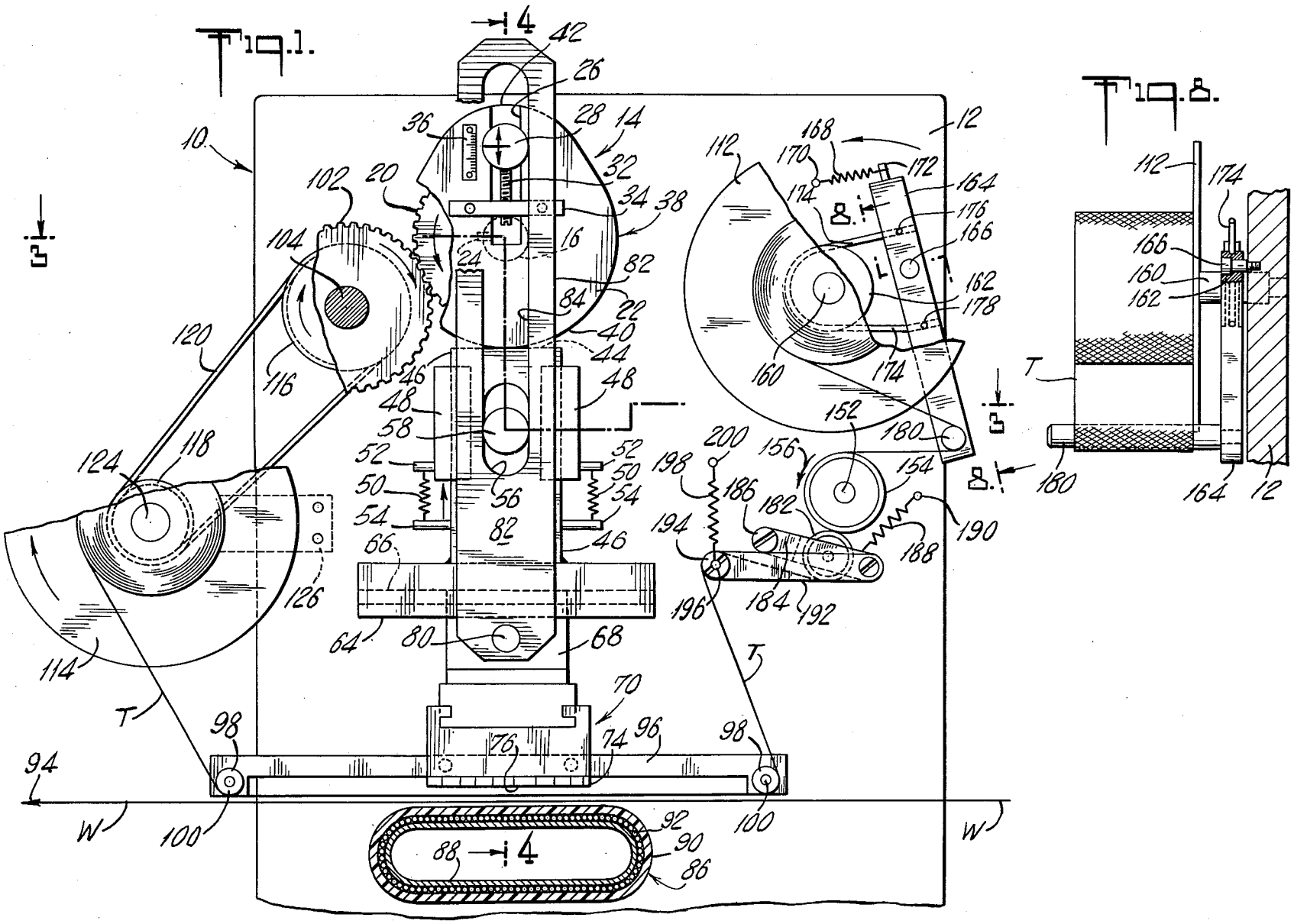

Referring now to FIGS. 1-4 and 13, the printing apparatus 10 depicted includes a main plate 12 which supports a print drive mechanism shown generally at 14.

The print drive mechanism includes a print shaft 16 journaled through main plate 12 and supported by bearings 18. A gear 20 and a cam 22 are mounted on shaft 16 and coupled thereto by key 24 for continuous rotation as a unit. Cam 22 is provided with a radially extending groove 26 formed in the side surface thereof. Groove 26 is of an essentially T-shaped cross-section for receipt of pivot rod 28, said pivot rod being of a diameter slightly smaller than the widest portion of groove 26 and being formed with a pair of opposed recesses 30 (see FIG. 13) for receiving the inwardly projecting walls defining the T-shaped cross-section of groove 26. In this manner, groove 26 defines a guide for the radial displacement of pivot rod 28 relative to the axis of rotation of cam 22 defined by shaft 16. This displacement is effected by an adjusting screw 32 rotatably mounted on pivot rod 28 and an adjusting screw support fixedly mounted to cam 22 so as to bridge and project into groove 26. Adjusting screw support 34 is provided with a threaded aperture which receives the correspondingly threaded adjusting screw 32, so that the radial position of pivot rod 28 is set by the rotation of adjusting screw 32. A scale 36 is mounted on the surface of cam 22 extending parallel to groove 26 to provide benchmarks for the positioning of pivot rod 28, as will more particularly be described below. The periphery of cam 22 defines a camming surface 38 provided with a first substantially circular region 40 and a second substantially circular region 42 of a radius of curvature greater than the radius of curvature of first region 40, said first and second regions merging in an essentially smooth curve.

Figure 4:
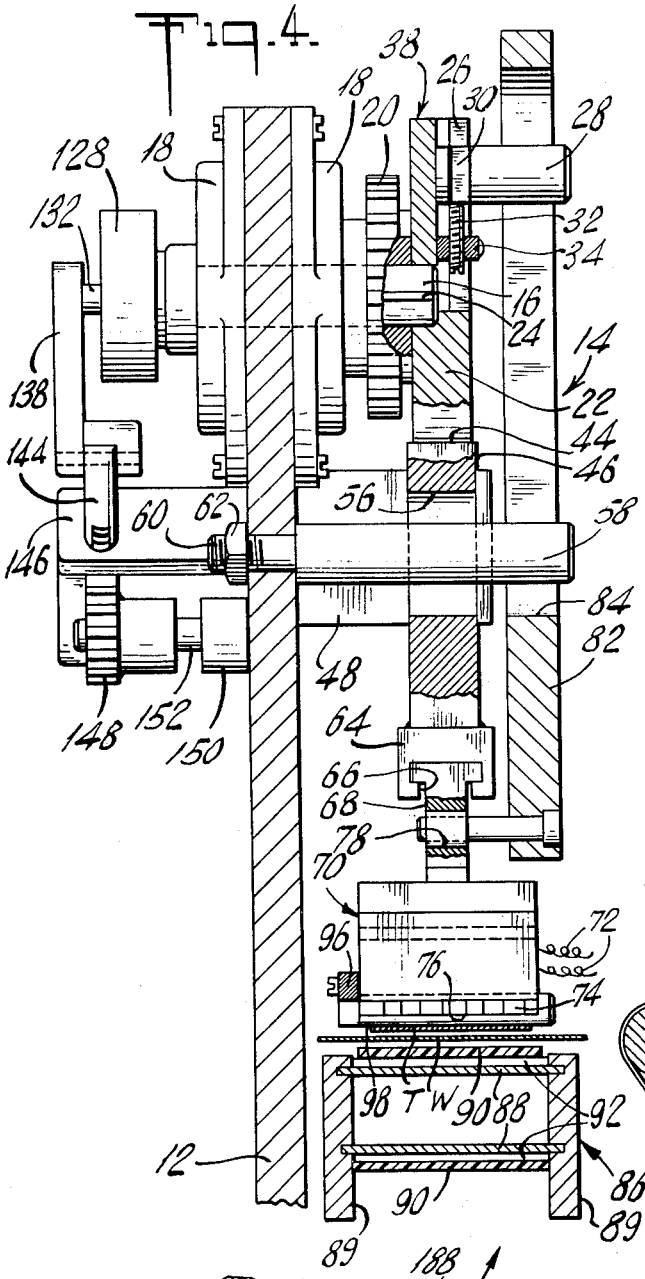

Camming surface 38 engages against end 44 of slide block 46 which is slidably mounted in a pair of fixed gibs 48 which are in turn mounted on main plate 12. Gibs 48 are positioned so as to permit the slidable displacement of slide block 46 toward and away from print shaft 16. Slide block 46 is biased against camming surface 38 by springs 50 respectively supported between first pins 52 each mounted on one of fixed gibs 48 and second pins 54 projecting laterally from slide block 46. Said slide block is formed with an axially extending slot 56 extending therethrough. A fixed pivot rod 58 is secured to main plate 12 by a threaded portion 60 and nut 62 as more particularly shown in FIG. 13. Said fixed pivot rods extends through and projects beyond slot 56 in slide block 46. A laterally extending guide block 64 is fixedly mounted to slide block 46 and provided with a T-shaped, laterally extending groove 66 in the bottom surface thereof. As best shown in FIG. 4, a print head support 68 of essentially T-shaped cross-section is slidably mounted in groove 66, a print head being mounted thereon. Said print head is of the heated variety, including therein heating elements connected to a source of power through leads 72. The print head carries removably mounted dies 74 in heat conducting relation with the heating elements. The dies may take any desired form including designs, lettering, selectively settable numbering units or the like and generally define a substantially plane operative surface 76.

Print head support 68 is formed with a bore 78 therethrough for receiving pivot pin 80 therein, said pivot pin being freely rotatable within bore 78. Said pivot pin is mounted to one end of a lever 82, said lever coupling being formed with an axially extending slot running from its central region to the region of the end thereof spaced from pivot pin 80. Slot 84 is dimensioned to receive fixed pivot rod 58 and displaceable pivot rod 28 in slidable relation.

A back-up member 86 is mounted in facing relation to operative surface 76 to print head 70. Said back-up member consists of an inner belt support 88 mounted on a frame 89 (FIG. 4) and supporting an endless belt 90 preferably formed of a low-friction plastic material. A set of roller bearings 92 are captured between the belt and belt support to minimize the friction therebetween and to render the belt essentially freely displaceable. Belt support 88 is shaped to support the belt along an essentially planar path on the side thereof facing operative surface 76. A web W is continuously displaced along a linear path intermediate operative surface 74 of print head 70 and endless belt 90 in the direction of arrow 94. A tape support bracket 96 is mounted on and extends laterally from print head 70 in a direction essentially parallel to the path of web W. A roller 98 is mounted on each end of tape support 96 and projects across the path of web W to support a segment of heat-released, pigment bearing tape T therebetween. Rollers 98 are freely rotatable on stub shafts 100 and normally support a section of pigment bearing tape T intermediate but out of engagement with print head 70 and endless belt 90. As shown in FIG. 3, gear 20 which drives print drive mechanism 14, is itself driven by gear 102 mounted on shaft 104, which is in turn rotatably mounted on main plate 12. Shaft 104, in the embodiment depicted in FIG. 3, supports a sprocket wheel 106 coupled by a chain 108 to the drive mechanism of a packaging machine so that each cycle of the packaging machine bears a fixed relation to the cycles of the printing apparatus 10. In one embodiment, this relation is one to one. In other words, one cycle of the printing machine, represented by one rotation of the web driving rollers 107 (FIG. 10) thereof corresponds to one rotation of gear 20 and cam 22. Stated otherwise, the angular velocity $n$ of cam 22 equals the angular velocity of web drive rollers 107.

The operation of the print drive mechanism 14 in accordance with the invention will be explained in connection with FIGS. 9, 10 and 11. In FIG. 9, the print drive mechanism 14 is depicted at a point in the cycle at which end surface 44 of slide block 46 engages a point on first region 40 of camming surface 38 before the transition to second region 42. FIG. 10 depicts the print mechansim during imprinting when end surface 44 of slide block 46 engages second region 42 of camming surface 38. FIG. 11 depicts print drive mechanism 14 after cam 40 has rotated in the direction of arrow 109 to a point where end surface 44 of slide block 46 again engages first region 40 of camming surface 38. FIG. 12 illustrates the path defined by print head 70. A first portion 110 of said path represents the period of imprinting during which print head 70 engages pigment bearing tape T and web W against endless belt 90 of back-up member 86 so that the heated die 74 of the printing head can release the pigment in tape T onto web W to effect imprinting. This portion of the print cycle is represented by FIG. 10. The remaining portions of the print cycle represented by FIGS. 9 and 11 are characterized by the print head being lifted away from back-up belt 90.

The motion of print head 70 has two components. The first component of motion of print head 70 is toward and away from back-up belt 90, which motion is caused by the engagement of camming surface 38 against end surface 44 of slide block 46 to displace said slide blick and print head as a unit against the action of springs 50. Since regions 40 and 42 of camming surface 38 are each of substantially circular cross-section, the path of print head 70 has two portions extending substantially parallel to the path of web W, one of them being the print portion 110 and two transition regions therebetween corresponding to the transition between the two camming regions.

The second component of the motion of print head 70 is essentially parallel to the path of web W and is represented by the sliding displacement of the print head and print head support 68 in groove 66 in guide block 64. This pivotable displacement is effected by lever coupling 82 which pivots about the fixed pivot rod 58 in response to the essentially reciprocating displacement of displaceable pivot rod 28 mounted on continuously rotating cam 22. This motion causes the reciprocating motion of print head 70 as illustrated in FIG. 12.

In order to effect clear printing without damaging web W, the velocity $V_p$ (FIG. 10) of the print head during the print portion 110 of the print cycle must be equal to the velocity $V_w$ of web W. Referring to FIG. 10, if $V_c$ represents the velocity of pivot rod 28, $n$ represents the angular velocity of cam 22, which is equal to the angular velocity of web drive rollers 107, and $C_o$ represents the cut-off length of the web W, then the following relationships apply:

$$V_w = V_p$$

$$V_w = nC_o$$

$$V_p = V_c(c/b)$$

$$V_c = \pi\ 2a\ n$$

$$V_p = \pi\ 2a\ n\ (c/b)$$

$$nC_o = \pi\ 2a\ n\ (c/b)$$

since $\pi$, 2 and $c$ are constant and equal to $K$, $$C_o = K\ (a/b)$$

From the last equation, we can see that the cut-off length is determined by the geometric dimension of the printer regardless of $n$. Once the dimension $a$ is set, the print head will move at a synchronized speed with the web regardless of how fast the packaging machine is rotating. The dimension $a$ is set by the radial positioning of movable pivot rod 28 relative to the axis of rotation of cam 22 defined by print shaft 16 through the use of adjusting screw 32. For each cut-off length $C_o$ set on the parent packaging machine, a corresponding cut-off length can be set on print drive mechanism 14 by positioning movable rod 28 so that the velocity of the printer $V_p$ equals the velocity of the web $V_w$ during the printing portion 110 of the cycle. The foregoing arrangement produces one imprint for each cut-off length of the parent packaging machine.

Turning now to the means for driving and guiding heat-released, pigment bearing tape T, said tape is supplied fromm a supply roll 112 and collected in a take-up roll 114. The mechanism for driving the tape is best shown in FIGS. 2–5 and 7. Shaft 104, which is driven by the parent packaging machine, also carried a first pulley wheel 116 for rotation therewith. Said first pulley wheel is coupled to a second pulley wheel 118 by belt 120 to continuously rotate second pulley wheel 118. The second pulley wheel is frictionally coupled to take-up roll 114 by slip clutch 122. Take-up roll 114, second pulley wheel 118 and slip clutch 122 are all mounted on stub shaft 124, which is in turn supported on bracket 126 mounted on main plate 12. The foregoing arrangement applies a constant tension on the tape T through take-up roll 114.

As noted above, and as shown in FIGS. 3 and 4, print shaft 16, which is continuously rotated and carries cam 22 of the print drive mechanism 14, is journaled through main plate 12. A wheel 128 is mounted on the end of print shaft 16 projecting from the side of main plate 12 opposite to that of cam 22, hereinafter referred to as the reverse side of said main plate. As best shown in FIG. 3, wheel 128 is formed with a radially extending groove 130 which receives the end of pin 132. A threaded second adjusting screw 134 is rotatably mounted on pin 132 and engaged in a threaded aperture in second adjusting screw support 136 which bridges and extends into groove 130. In this manner, the rotation of second adjusting screw 134 radially positions pin 132 relative to the axis of rotation of wheel 128, as defined by drive shaft 16. Pin 132 is rotatably mounted on one end of bar 138. Bar 138 reciprocates in the direction of double headed arrow 140 (FIG. 2) in response to the continuous rotation of wheel 128 in the direction of arrow 142

Figure 5:
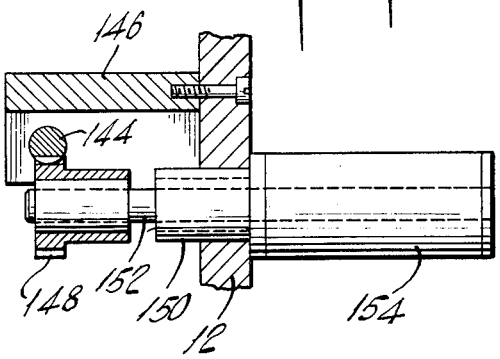
FIG. 5 is a sectional view taken along lines 5—5 of FIG. 2.

(FIG. 2) in a bell crank mechanism. Rack 144 is pivotably mounted on the other end of bar 138 and slidably supported in bracket 146. Rack 144 is likewise reciprocally displaced in the direction of arrows 140. A pinion 148 is positioned in meshing engagement with rack 144 and is driven thereby. Pinion 148 is coupled to one way clutch mechanism 150 through shaft 152, all of which are supported on main frame 12, as shown in FIG. 5. One way clutch 150 translates the reciprocating motion of pinion 148 into one way rotation of tape drive roller 154 which projects from the front of main plate 12. One way clutch 150 is adapted to drive tape drive roller 154 in the direction of arrow 156 (FIG. 1) when pinion 148 is rotated in the direction of arrow 158 (FIG. 2) which in turn occurs when rack 144 and bar 138 is moving in the direction of the upper right hand corner of FIG. 2 as viewed in FIG. 2. When rack 144 is displaced in the direction of the lower left hand corner of FIG. 2, as viewed in FIG. 2, pinion 148 rotates in a direction opposite to arrow 158 but tape drive roller 154 is stationary.

The orientation of wheel 128 relative to cam 22 is such that the tape drive roller is advanced during the portion of the cycle that first region 40 of camming surface 38 engages the end surface 44 of slide block 46. In other words, tape advance occurs during the period that print head 70 is displaced along a portion of its path extending substantially parallel to the web W but spaced therefrom. The length of tape advanced during each cycle, as determined by the angular displacement of tape drive roller 154, is selectively adjusted by means of second adjusting screw 134 which, in effect, sets the transverse of rack 144 in proportion to the spacing between pin 132 and the axis of rotation of wheel 128.

Referring now to FIGS. 1, 2 and 6–8, the tape guide mechanism in accordance with the invention will be described. Supply roll 112 is mounted on stub shaft 160 which is rotatably mounted on plate 12. Said stub shaft also supports a tension pulley 162 which rotates with said shaft. A lever arm 164 is pivotably mounted on main plate 12 adjacent stub shaft 160 by means of pin 166 (FIG. 8). Lever arm 164 is normally biased in a counter clockwise direction about pin 166 as viewed in FIG. 1 by means of spring 168 coupling pin 170 mounted on main plate 12 and pin 172 mounted on the end of lever arm 164. A tension belt 174 extends about tension pulley 162 and is coupled, at its ends, to spaced points 176 and 178 on lever arm 164, said spaced points being positioned on opposed sides of pivot pin 166. A guide roller 180 is rotatably mounted on the end of lever arm 164 spaced from spring 168. Tape T extends from supply roll about 112 about roller 180 and from said roller, to tape drive roller 154, where it passes between said tape drive roller and a pinch roller 182.

Lever arm 164 and tension belt 174 serve as a brake on supply roll 112 during the period that no tape is fed. When the tape is to be fed, the rotation of tape drive roller 154 in the direction of arrow 156 pivots lever arm 164 in the clockwise direction as viewed in FIG. 1, against the action of spring 168, to relieve the braking force on supply roller 112 to permit even tape feeding.

Figure 7:
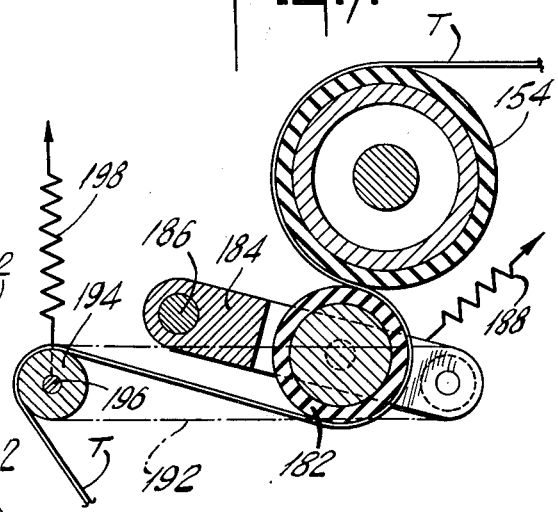
FIG. 7 is a sectional view taken along lines 7—7 of FIG. 6.
Figure 6:
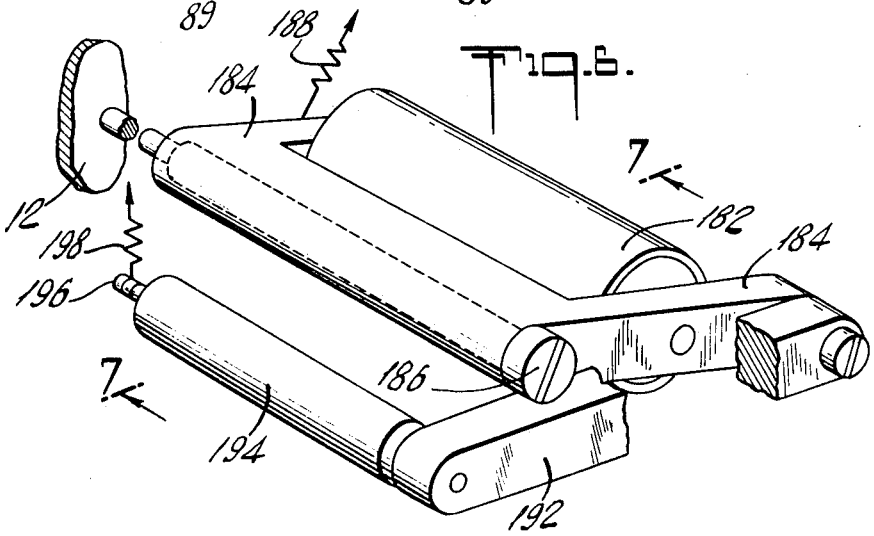
FIG. 6 is an enlarged perspective view of the pigment bearing tape tensioning device in accordance with the invention.
Figure 13:
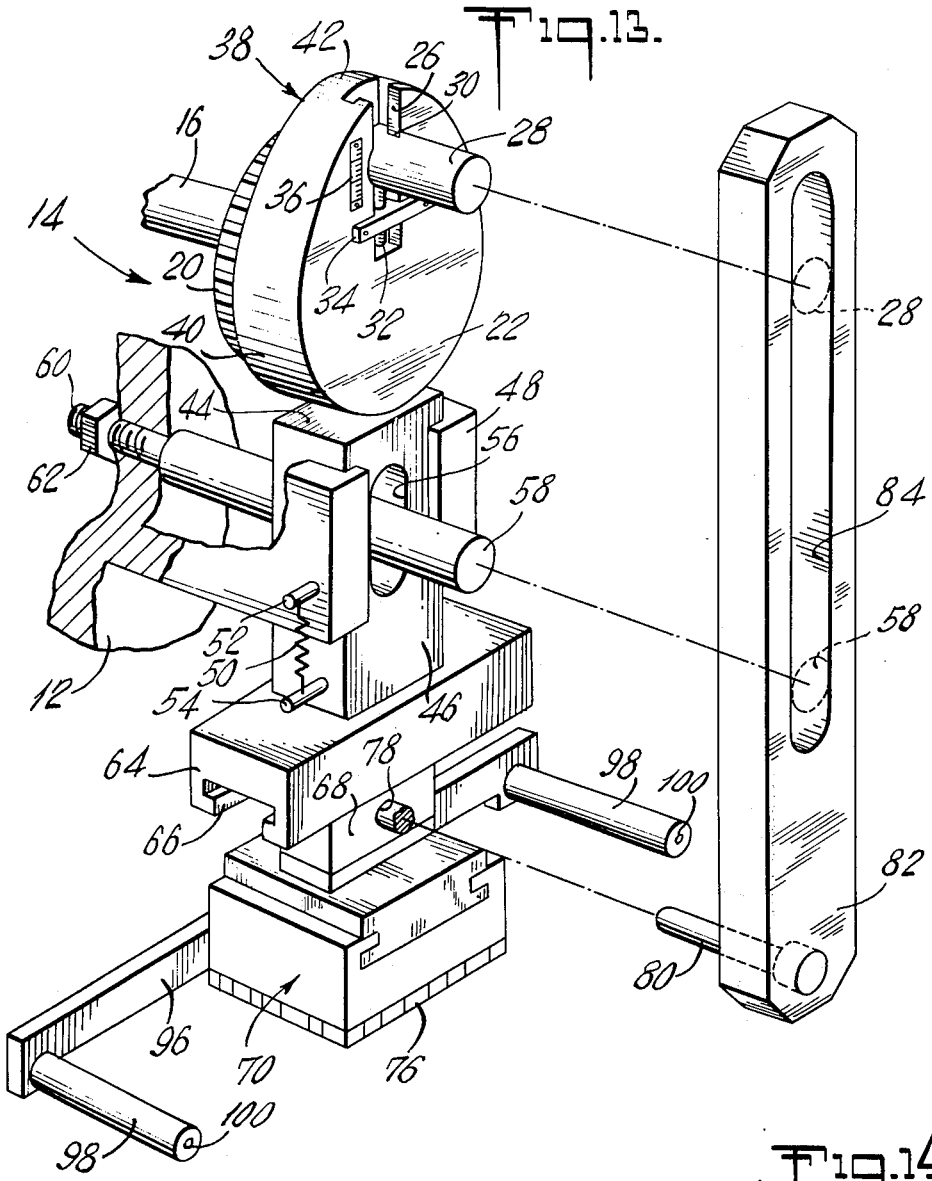
FIG. 13 is an enlarged exploded perspective view of the print head displacing mechanism of the printing apparatus of FIG. 1.

As is more particularly shown in FIGS. 6 and 7, pinch roller 182 is rotatably mounted between the arms of a U-shaped pinch support 184. Said pinch support is pivotably mounted at the base region thereof bridging said arms by bolt 186 and is biased in the counter clockwise direction as viewed in FIG. 7 about bolt 186 by spring 188 coupled between the end of one of the arms of pinch support 184 and pin 190 mounted on main plate 12. This arrangement serves to bias pinch roller 182 against tape drive roller 154 to insure affirmative advance of the tape roller.

A dancing roller lever 192 is pivotably mounted at one end to the end of one of the arms of pinch support 184. The other end of dancing roller lever 192 rotatably supports a dancing roller 194 on a stub shaft 196 (FIG. 6), the end of said stub shaft being coupled by spring 198 to pin 200 mounted on main plate 12. Spring 198 biases dancing roller 194 in the upward direction as viewed in FIG. 1 to apply a tension to tape T which is passed about said dancing roller about passing between pinch roller 182 and tape drive roller 154. From dancing roller 154, the tape passes about rollers 98 supported on tape support 96, all of which are displayed with print head 70. This displacement could cause variations in tension in tape T, which variations are absorbed by dancing roller 194 through the pivoting of dancing roller lever 192 in opposition to the force of spring 198. The tape passes from the printing position between rollers 98 to take-up roll 114.

Figure 14:
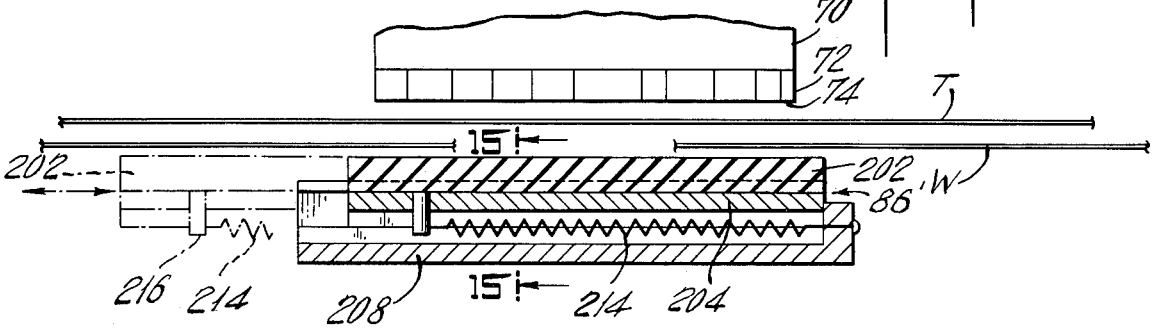
FIG. 14 is a side elevational view of an alternate embodiment of the back-up member of the printing apparatus in accordance with the invention.
Figure 15:
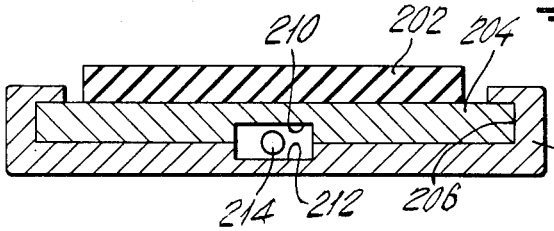
FIG. 15 is a sectional view taken along lines 15—15 of FIG. 14.

Reference is now made to FIGS. 14 and 15, in which an alternate embodiment of the back-up member 86' is depicted. In place of the endless belt 90, the back-up is defined by a pad 202, formed, for example, of a flat piece of rubber, mounted on a sliding support plate 204. The sliding support plate is received within a T-shaped groove 106 in fixed guide 208. Mating notches 210 and 212 in the facing surfaces of sliding support plate 204 and fixed guide 208 define a passage for receiving a spring 214 extending between fixed guide 208 and a pin 216 mounted on sliding support plate 204. The passage defined by groove 210 and 212 and spring 214 extend substantially parallel to the path of web W. During the printing portion of the cycle when print head 70 engages tape T and web W against pad 202, said pad is displaced to the left as viewed in FIG. 14 as illustrated by the changed position shown in dashed lines in FIG. 14. At the end of the print portion of the cycle, print head 70 is lifted and pad 202 and sliding support plate 204 are released and returned to their original position by the action of spring 214.

While the foregoing embodiments depict a back-up member which is displaced along the path of web W during the print portion of the cycle by means of the engagement thereagainst and the displacement of print head 70, means may be provided for affirmatively driving the back-up means, if desired. In addition, while the foregoing printing device illustrates an arragement wherein a printing apparatus is driven on a one to one relation to the parent printing machine, other predetermined relations may be established.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A printing apparatus for webs continuously moving along a first path comprising printing means positioned on one side of the path; back-up means on the other side of said path facing said printing means; means for cyclically displacing said printing means along a second path having a first portion extending substantially along said first path and a second portion spaced from said first path, said printing means engaging said web against said back-up means while in said first portion of said second path to effect printing, said means for displacing said printing means including a first displacing means for displacing the printing means toward and away from said web and a second displacing means for displacing the printing means substantially parallel to said first path, said first displacing means being operatively coupled to said second displacing means for the coordinate operation thereof, said second displacing means including a wheel continuously rotating about its axis, a displaceable pivot means mounted on said wheel at a location radially spaced from said wheel axis, a fixed pivot means positioned intermediate said wheel axis and said printing means, and means coupling said displaceable pivot means and said printing means, said coupling means being pivotally mounted on said printing means and formed with a slot means for receiving said displaceable and fixed pivot means to permit pivotable and lateral displacement of said coupling means relative to said displaceable and fixed print means, said coupling means pivoting about said fixed pivot means in response to the rotatable displacement of said displaceable pivot means on said wheel to reciprocally displace said printing means in a direction substantially parallel to said first path, said means for displacing said printing means including means for selectively adjusting the velocity of said printing means so that said printing means and web are moving at substantially the same velocity while said printing means is traversing said first portion of said second path and printing is effected; and means for displacing said back-up means with said web and printing means when said printing means engages said web thereagainst.

2. A printing apparatus as recited in claim 1, wherein said back-up means includes a back-up member freely displaceable at least in the direction of movement of said web, said means for displacing said back-up means comprising the engagement thereagainst of said printing means for carrying said back-up member therewith.

3. A printing apparatus as recited in claim 2, wherein said back-up member includes an endless belt and support means freely rotatably supporting said endless belt.

4. A printing apparatus as recited in claim 3, wherein said support means includes a fixed support member and roller means intermediate said fixed support member and said endless belt.

5. A printing apparatus as recited in claim 2, wherein said back-up member includes a pad, said back-up means including means for supporting said pad for sliding displacement substantially parallel to the path of said web from a rest position; and means for biasing said pad in the direction of said rest position to return said pad to its rest position when said printing means disengages therefrom at the end of said first portion of said second path.

6. A printing apparatus as recited in claim 1, wherein said printing means includes a heated die, said printing apparatus including means for incrementally advancing lengths of heat-released, pigment bearing tape into the region intermediate said printing means and back-up means during the period that said printing means is traversing the second portion of said second path, said heated die engaging said pigment bearing tape against said web during the period that said printing means is traversing the first portion of said second path.

7. A printing apparatus as recited in claim 6, for printing on a web to be fed to a packaging means, said packaging means being coupled to said web for advancing said web at a selected velocity, said packaging means cyclically operating on successive cut-off lengths of said web, each cycle of said packaging machine being of a predetermined selected duration, said cut-off lengths being of a predetermined selected length, said web velocity being determined by the duration of each cycle of said packaging means and the selected cut-off length of said web, and including means for coupling said means for cyclically displacing said printing means and said packaging means to maintain a predetermined relation between the duration of each cyle of said means for cyclically displacing said printing means and of each cycle of said packaging means, whereby said means for selectively adjusting the velocity of said printing means may be calibrated to relate to said cut-off lengths so that said printing apparatus effects printing a predetermined number of times on each cut-off length of said web without regard to changes in the duration of the cycle of the packaging means.

8. A printing apparatus as recited in claim 7, wherein said predetermined relation between the respective cycle durations of said means for cyclically displacing said printing means and said packaging means is one to one.

9. A printing apparatus as recited in claim 6, wherein said back-up means includes a back-up member freely displaceable at least in the direction of movement of said web, said means for displacing said back-up means comprising the engagement thereagainst of said printing means for carrying said back-up member therewith.

10. A printing apparatus as recited in claim 9, wherein said back-up member includes an endless belt and support means freely rotatably supporting said endless belt.

11. A printing apparatus as recited in claim 10, wherein said support means includes a fixed support member and roller means intermediate said fixed support member and said endless belt.

12. A printing apparatus as recited in claim 9, wherein said back-up member includes a pad, said back-up means including means for supporting said pad for sliding displacement substantially parallel to the path of said web from a rest position; and means for biasing said pad in the direction of said rest position to return said pad to its rest position when said printing means disengages therefrom at the end of said first portion of said second path.

13. A printing apparatus as recited in claim 6, including print drive means and means coupling said print drive means to said means for displacing said printing means and said tape advancing means for the coordinate actuation thereof.

14. A printing apparatus as recited in claim 6, including tape support means coupled to said printing means for displacement therewith for supporting the length of tape in the region intermediate said printing means and back-up means during the traverse of said first portion of said second path by said printing means, whereby said length of tape is displaced therewith at substantially the same velocity as said web.

15. An apparatus as recited in claim 8, including a supply roll, a take-up roll, and means for guiding said incrementally advanced tape from said supply roll, through said tape advancing means and said tape support means coupled to said printing means, to said take-up roll; said guide means including dancing roller means engaging said tape, means for displaceably supporting said dancing roller means and means for biasing said dancing roller support means to apply tension to said tape while permitting displacement thereof by said tape support means during the period that said printing means is traversing said first portion of said second path.

16. A printing apparatus as claimed in claim 14, for printing on a web to be fed to packaging means, said packaging means being coupled to said web for advancing said web at a selected velocity, said packaging means cyclically operating on successive cut-off lengths of said web, each cycle of said packaging machine being of a predetermined selected duration, said cut-off lengths being of a predetermined selected length, said web velocity being determined by the duration of each cycle of said packaging means and the selected cut-off length of said web, and including means for coupling said means for cyclically displacing said printing means and said packaging means to maintain a predetermined relation between the duration of each cycle of said means for cyclically displacing said printing means and of each cycle of said packaging means, whereby said means for selectively adjusting the velocity of said printing means may be calibrated to relate to said cut-off lengths so that said printing apparatus effects printing a predetermined number of times on each cut-off length of said web without regard to changes in the duration of the cycle of the packaging means.

17. A printing apparatus as recited in claim 16, wherein said predetermined relation between the respective cycle duration of said means for cyclically displacing said printing means and said packaging means is one to one.

18. A printing apparatus as recited in claim 6, wherein said means for incrementally advancing said tape includes a continuously rotating wheel means, means for translating said continuous rotation to reciprocating rotation; and one-way clutch means operatively coupled to said tape for incrementally advancing said tape during one direction of said reciprocal rotation.

19. A printing apparatus as recited in claim 18, wherein said rotating to reciprocating motion translating means includes bell-crank means coupled to said continuously rotating wheel means for reciprocal linear displacement, said bell-crank means including a pivot member mounted on said wheel means and means for selectively adjusting the radial spacing between said pivot member and the axis of rotation of said continuously rotating wheel means, whereby the length of reciprocating displacement of said bell-crank means is selectively adjusted to thereby selectively adjust the length of tape incrementally advanced during each rotation of said continuously rotating wheel means.

20. An apparatus as recited in claim 19, including rack means operatively coupled to said bell-crank means for reciprocal displacement thereby, and pinion means operatively coupled to said rack means for reciprocating rotation thereby and coupled to said one-way clutch means for driving same.

21. A printing apparatus as recited in claim 1, wherein said second displacing means includes cam means mounted for continuous rotation about an axis and having a camming surface variously spaced from said axis and means coupling said printing means to said camming surface for effecting the displacement of said printing means toward and away from said web.

22. An apparatus as recited in claim 1, wherein said means for selectively adjusting the velocity of said printing head includes means for selectively positioning said displaceable pivot means radially relative to the axis of rotation of said continuously rotating wheel means.

23. An apparatus as recited in claim 22, wherein said second displacing means includes cam means mounted for continuous rotation about an axis and having a camming surface variously spaced from said axis and means coupling said printing means to said camming surface for effecting the displacement of said printing means toward and away from said web.

24. A printing apparatus as recited in claim 23, wherein said back-up means includes a back-up member freely displaceable at least in the direction of movement of said web, said means for displacing said back-up comprising the engagement thereagainst of said printing means for carrying said back-up member therewith.

25. A printing apparatus as recited in claim 24, wherein said back-up member includes an endless belt and support means freely rotatably supporting said endless belt.

26. A printing apparatus as recited in claim 25, wherein said support means includes a fixed support member and roller means intermediate said fixed support member and said endless belt.

27. A printing apparatus as recited in claim 24, wherein said back-up member includes a pad, said back-up including means for supporting said pad for sliding displacement substantially parallel to the path of said web from a rest position; and means for biasing said pad in the direction of said rest position to return said pad to its rest position when said printing means disengages therefrom at the end of said first portion of said second path.

28. An apparatus as recited in claim 23, wherein said continuously rotating cam defines said wheel means and supports said displaceable pivot means and means for selectively positioning said displaceable pivot means.

29. An apparatus as recited in claim 28, wherein said means for positioning said displaceable pivot means includes a radially extending groove in said cam for receiving said displaceable pivot means, a threaded adjusting screw rotatably mounted on said displaceable pivot means; and an adjusting support fixedly mounted to said cam means and bridging said groove, said adjusting support means having a threaded aperture therethrough for receipt of said adjusting screw whereby rotation of said adjusting screw radially displaces said displaceable pivot means.

30. An apparatus as recited in claim 23, wherein said means coupling said camming surface and said printing means includes a slide-block means mounted for slidable displacement toward and away from said web and engaging said camming surface; guide block means mounted on said slide-block means for displacement therewith and means for slidably supporting said printing means on said guide block means in a direction substantially parallel to said first path, said printing means being displaced with said slide block toward and away from said web.

31. An apparatus as recited in claim 1, for printing on a web to be fed to a packaging means, said packaging means being coupled to said web for advancing said web at at selected velocity, said packaging means cyclically operating on successive cut-off lengths of said web, each cycle of said packaging machine being of a predetermined selected duration, said cut-off lengths being of a predetermined selected length, said web velocity being determined by the duration of each cycle of said packaging means and the selected cut-off length of said web, and including means for coupling said means for cyclially displacing said printing means and said packaging means to maintain a predetermined relation between the duration of each cycle of said means for cyclically displacing said printing means and of each cycle of said packaging means, whereby said means for selectively adjusting the velocity of said printing means may be calibrated to relate to said cut-off lengths so that said printing apparatus effects printing a predetermined number of times on each cut-off length of said web without regard to changes in the duration of the cycle of the packaging machine.

32. An apparatus as recited in claim 31, wherein said predetermined relation between the respective cycle time of said means for cyclically displacing said printing means and said packaging means is one to one.

33. A printing apparatus as recited in claim 1, wherein said second displacing means includes cam means mounted for continuous rotation about an axis and having a camming surface variously spaced from said axis and means coupling said printing means to said camming surface for effecting the displacement of said printing means toward and away from said web.

34. A printing apparatus as claimed in claim 1, wherein said coupling means includes a lever arm having a centrally slotted portion for engagement against said fixed pivot means; a first slotted portion on one side of said centrally slotted portion for engagement with said displaceable pivot means; and a second portion on the other side of said centrally slotted portion pivotably coupled to said printing means, said lever arm pivoting about said fixed pivot means in response to the rotatable displacement of said pivot means on said wheel to reciprocally displace said printing means in a direction substantially parallel to said first path.

35. A printing apparatus as recited in claim 34, wherein said means for selectively adjusting the velocity of said printing head includes means for selectively positioning said displaceable pivot means radially to the axis of rotation of said continuously rotating wheel means.

36. A printing apparatus as recited in claim 35, wherein said second displacing means includes cam means mounted for continuous rotation about an axis and having a camming surface variously spaced from said axis and means coupling said printing means to said camming surface for effecting the displacement of said printing means toward and away from said web.

37. A printing apparatus as recited in claim 36, wherein said continuously rotating cam defines said wheel means and supports said displaceable pivot means and means for selectively positioning said displaceable pivot means.

38. A printing apparatus as recited in claim 37, wherein said means for positioning said displaceable pivot means includes a radially extending groove in said cam for receiving said displaceable pivot means, a threaded adjusting screw rotatably mounted on said displaceable pivot means; and an adjusting support fixedly mounted to said cam means and bridging said groove, said adjusting support means having a threaded aperture therethrough for receipt of said adjusting screw whereby rotation of said adjusting screw radially displaces said displaceable pivot means.

39. A printing apparatus as recited in claim 38, wherein said means coupling said camming surface and said printing means includes slide-block means mounted for slideable displacement toward and away from said web and engaging said camming surface; guide block means mounted on said slide-block means for displacement therewith and means for slidably supporting said printing means on said guide block means in a direction substantially parallel to said first path, said printing means being displaced with said slide-block toward and away from said web.

* * * * *